United States Patent [19]

Giangrasso

[11] Patent Number: 4,748,774

[45] Date of Patent: Jun. 7, 1988

[54] PIN GRINDING FIXTURE

[76] Inventor: Joseph A. Giangrasso, 11221 Elvessa Street, Oakland, Calif. 94605

[21] Appl. No.: 1,907

[22] Filed: Jan. 9, 1987

[51] Int. Cl.[4] ..... B24B 41/06

[52] U.S. Cl. ..... 51/217 R; 51/216 R

[58] Field of Search ..... 51/217 R, 220, 217 P, 51/219 R, 216 R, 216 P; 269/902, 95

[56] References Cited

U.S. PATENT DOCUMENTS

| | | | |
|---|---|---|---|
| 389,095 | 9/1888 | Mossberg | 51/219 R |
| 425,839 | 4/1890 | Walker | 51/219 R |
| 1,052,073 | 2/1913 | Mallory | 51/219 R |
| 2,524,279 | 10/1950 | Van Wyk | 51/219 R |
| 3,380,200 | 4/1968 | Kirwin | 51/219 R |

*Primary Examiner*—Frederick R. Schmidt
*Assistant Examiner*—Robert A. Rose
*Attorney, Agent, or Firm*—Linval B. Castle

[57] ABSTRACT

A clamping fixture specifically designed for securing rods, such as ejector pins used in injection molding processes, that are to be accurately ground to a specific length. The fixture includes an adjustable stop member for indexing the end of a rod and a jaw block with an elongated V-groove and movable jaw for securing the rod along a length thereof. The movable jaw includes an novel angled ramp member for lifting a rod into a position to be clamped in the V-groove.

6 Claims, 2 Drawing Sheets

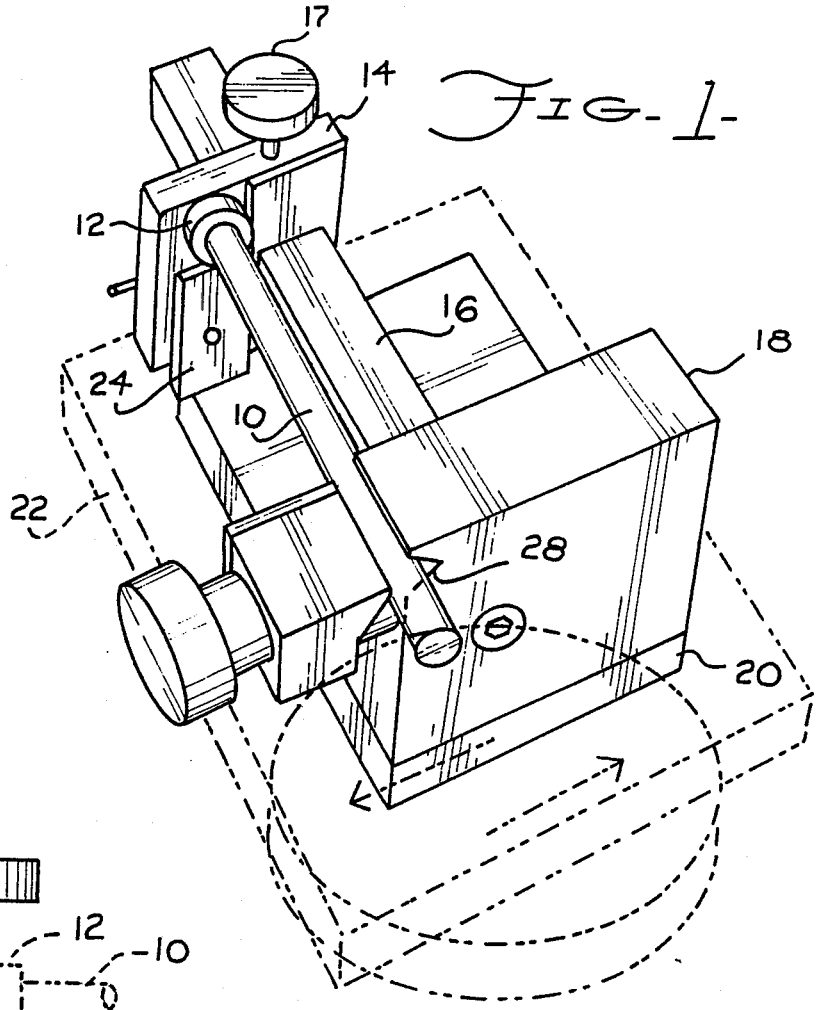
FIG. 1.
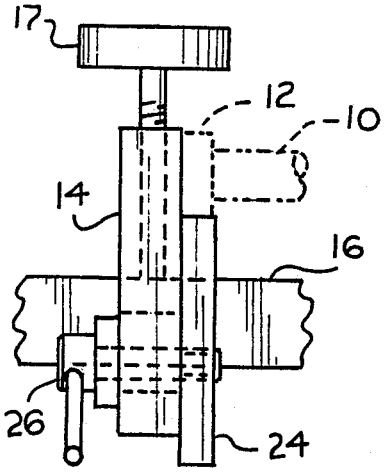
FIG. 3.
FIG. 4.
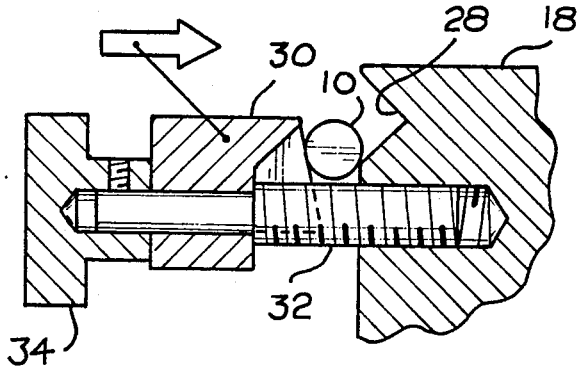

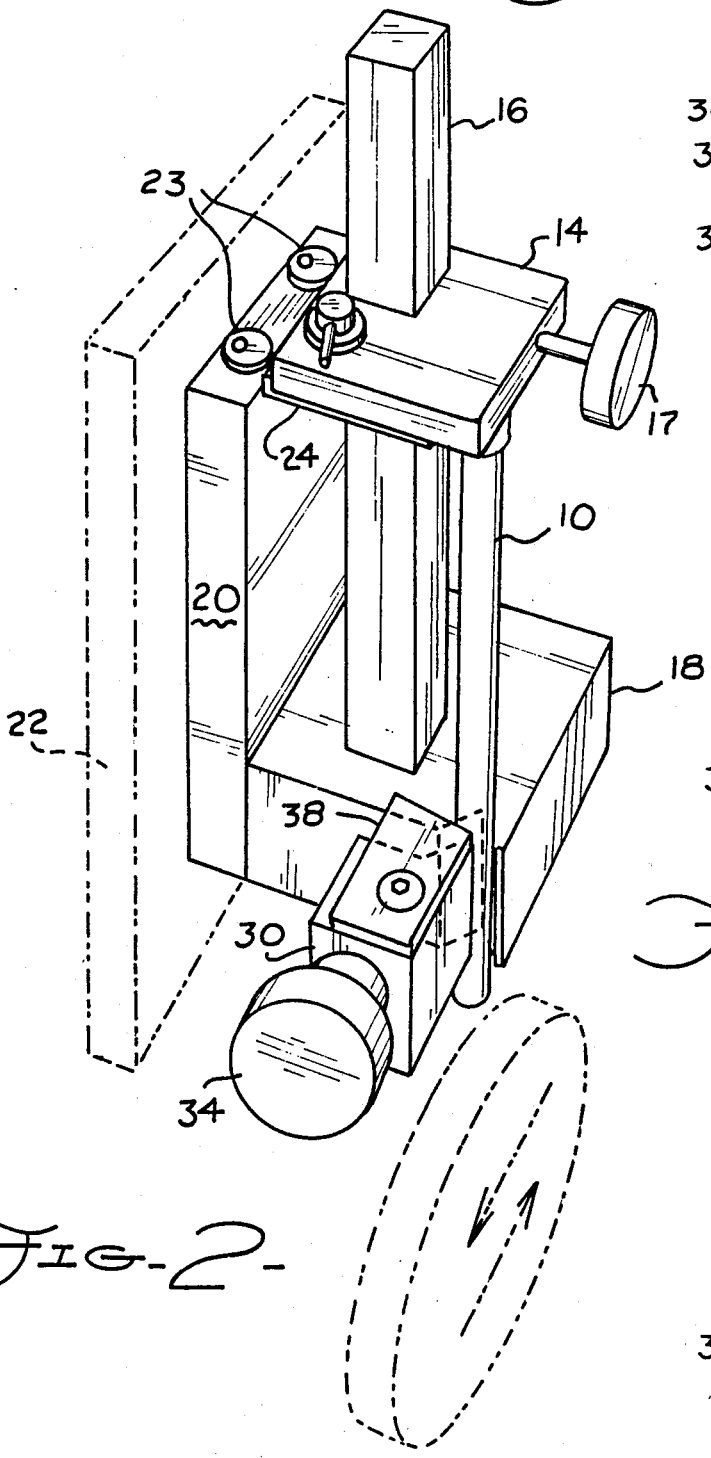
FIG. 2
FIG. 5
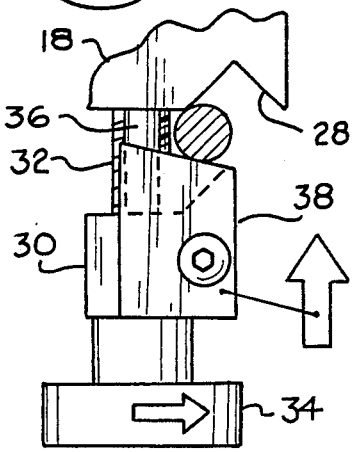
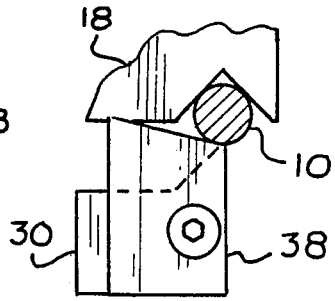
FIG. 6
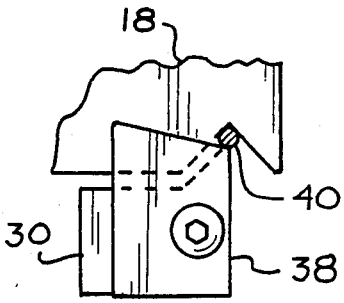
FIG. 7

PIN GRINDING FIXTURE

BRIEF SUMMARY OF THE INVENTION

This invention relates to machine shop tooling and in particular to a special vise for rapidly indexing and securing a rod so that the rod may be ground to a precise predetermined length.

The fixture is particularly adaptable for the precision grinding of pluralities of identical ejector pins used for the removal of cast products from injection molding equipment. In such processes, as many as several dozen ejector pins having identical lengths may be required. The problem is to produce such a plurality of pins with accurate and repeatable results and within required tolerances.

A conventional V-block is unsuitable for securing a pin because the pin, seated within the "V", is clamped therein with a single bolt which will put a small kink in pins of relatively small diameters. Further, there is no convenient end stop with which to index one end of the pin which the opposite pin end is being ground. A drill press vise provides a more accurate means for securing a rod or pin because it grasps a longer portion of the pin and thus avoids the possibility of a kink. But again, there is no convenient end stop for indexing one end and, additionally, considerable time is required for removing a ground ejector pin and inserting a new one to be ground.

The pin grinding fixture to be described provides an adjustable end stop for indexing the first end of a pin and convenient three-point pressure jaws which securely grips the pin near its second end and provides a straight in-line positioning system. A novel feature which permits high speed changes of the pins is a positioning wedge mounted to the moveable jaw and having an angled working surface for lifting a pin into jaw clamping position. The second end of the rod of pin is then exposed for grinding.

BRIEF DESCRIPTION OF THE DRAWINGS

In the drawings which illustrate the preferred embodiment of the invention:

FIG. 1 is a horizontal perspective view of the pin grinding fixture;

FIG. 2 is a vertical perspective view of the pin grinding fixture;

FIG. 3 is a side elevational view of the moveable stop and pin support plate at the end of the stationary shaft of the fixture;

FIG. 4 is a sectional elevational view of the clamping jaws of the fixture; and

FIGS. 5–7 illustrate the operation of the positioning wedge in centering various diameter pins in the clamping jaws of the fixture.

DETAILED DESCRIPTION OF THE INVENTION

As previously noted, the pin grinding fixture is particularly useful for grinding to a predetermined length a plurality of ejector pins such as used to release items from injected molds. Ejector pins, such as the pin 10 in FIG. 1, may have diameters that vary from approximately 1/16 inch to ¾ inch or larger and are usually about six to eight inches in length with a larger diameter head 12 at a first end. It is important that all ejector pins for any particular ejection mold be equal in length to within a tolerance of about 0.001 inch and therefore all such pins must be accurately sized to the precise length by grinding the second end opposite the larger diameter head 12.

The pin grinding fixture supports an ejector pin 10 for grinding as shown in FIG. 1. The pin head 12 abuts the flat vertical surface of a movable stop member 14 that is adjustable along the length of a stationary shaft 16 and locked thereto by a locking screw and knob 17. The end of the shaft 16 is rigidly attached to a jaw block 18 which in turn is supported on a flat base 20 that is preferably ferromagnetic so that it's flat bottom surface may be secured by a magnetic chuck 22 which is shown in dashed lines and which does not form a part of the invention.

As shown in FIG. 2, the pin grinding fixture may, if desired, be vertically positioned so that the ejector pin 10 is vertical and its second end may be ground by a wheel on a horizontal axis as shown in dashed lines. FIG. 2 illustrates the details of eccentric discs 23 which are attached to the end of the base 20 and which have off-center mounting holes to permit the discs to be rotated down below the lower edge surface of the base 20 and thus operate as stops or an index against the edge of a table or magnetic chuck.

Adjustably attached to the surface of the stop member 14 and facing the jaw block 18 is a small pin support plate 24 as best shown in FIG. 3. The pin support plate 24 is vertically adjustable approximately ¼ inch and is locked in a desired position by a flanged locking screw 26 which passes through a vertically elongated slot in the stop member 14 and into a threaded hole in the support plate 24. Once properly adjusted to a pin with a certain diameter head, subsequent pins with similar heads are quickly and accurately positioned by placing their heads on the top edge surface of the pin support plate 24 and against the face of the stop member 14.

The second end of the ejector pin 10, opposite its head 12, is secured by a jaw clamp which includes a V-groove 28 substantially parallel with the base 20 and the top surface of the jaw block 18, as best shown in the sectional view of FIG. 4. Positioned to engage the apex of the "V" in the groove 28 is the apex of a jaw 30 which is preferably formed at the intersecting edge of the top flat surface of the jaw member and a plane formed parallel with the lower portion of the V-groove 28. By use of a screw 32 and knob 34, the jaw 30 is movable inward to engage the ejector pin 10 near its second end. A sliding guide rod 36, shown in FIG. 5, is positioned adjacent and parallel to the screw 32 to prevent rotation of the jaw 30 around the screw 32.

Secured to the side surface of the jaw 30 by a machine screw is a pin positioning wedge 38, as illustrated in FIGS. 5 through 7. The wedge 38 functions to position a rod or pin, such as the pin 10, into the apex of the V-groove 28 as the jaw 30 is being tightened. The edge surface of the wedge that contacts the pin 10 is preferably smooth for a minimum of friction and is cut at a ramp angle of approximately 13° with respect to the horizontal so that a pin will slide on the ramp of the wedge and into the V-groove in the jaw block 18. FIG. 6 illustrates the final seating position of the pin 10 originally shown in FIG. 5. FIG. 7 illustrates that a very small diameter pin 40 becomes similarly seated in the V-groove by the action of the positioning wedge 38 as the jaw 30 is closed.

The pin grinding fixture is particularly valuable for end grinding a plurality of identical rods of ejector pins.

The fixture is quickly adjusted to the first pin in a series by first adjusting the position of the stop member 14 along the stationary shaft 16 so that the second end of the pin extends about ¼ inch beyond the jaw block 18. The member 14 is then locked by locking screw and knob 17. The jaw 30 is then closed to clamp the pin in the jaw block 18 and the pin support plate 24 is then adjusted to contact the side of the pin head and is then locked by its locking screw 26. The fixture is thus properly adjusted to end grind to close tolerances that particular pin and all subsequent identical pins.

I claim:

1. A fixture for supporting a rod in a position for grinding its first end, said fixture including:

a rigid base having a top surface and a substantially flat bottom surface;

a jaw block connected to said base and extending above the top surface thereof, said jaw block having an elongated V-groove in a first side surface and aligned parallel with the flat bottom surface of said base;

a movable jaw having an elongated jaw member parallel to said V-groove and positioned to be moved into engagement into said elongated V-groove;

adjusting means for moving said movable jaw toward and from said first side surface of said jaw block;

rod positioning means attached to a side surface of said movable jaw, perpendicular to and facing said V-groove, said positioning means having an angled surface facing said jaw block for positioning a rod in said V-groove upon movement of said movable jaw toward said jaw block; and rod stop means adjustably located at a predetermined distance from said jaw block for indexing a second end of a rod to be secured in said V-groove.

2. The fixture claimed in claim 1 wherein said rod positioning means is a plate mounted to a side surface of said movable jaw, the surface of said plate facing said jaw block being angled at approximately 13° with respect to a line perpendicular to said flat base.

3. The fixture claimed in claim 2 wherein said rod stop means is longitudinally adjustable on a stationary shaft having one end attached to said jaw block, said shaft being aligned parallel with said V-groove.

4. The fixture claimed in claim 3 further including a pin support plate adjustably mounted to a side surface of said rod stop means facing said jaw block, said pin support plate for supporting in axial alignment the second end of a rod indexed against said stop means.

5. The fixture claimed in claim 4 further including at least one stop member rotatably connected to said rigid base and on the end thereof opposite said jaw block, said stop member being rotatable to extend below the flat bottom surface of said base for indexing said base against an edge of a mounting plate.

6. The fixture claimed in claim 5 wherein said stop member is a disc having an off-center mounting hole for eccentrically mounting said disc to said base.

* * * * *